US005261661A

United States Patent [19]

Lemmon

[11] Patent Number: 5,261,661

[45] Date of Patent: Nov. 16, 1993

[54] TRAINING FOOTBALL

[76] Inventor: Joe Lemmon, 11638 Riverside Dr., #6, North Hollywood, Calif. 91602

[21] Appl. No.: 903,511

[22] Filed: Jun. 24, 1992

[51] Int. Cl.[5] ..... A63B 41/02

[52] U.S. Cl. ..... 273/65 EC; 273/DIG. 20

[58] Field of Search ..... 273/DIG. 20, 65 EF, 273/58 G, 65 EC, 65 R, 213

[56] References Cited

U.S. PATENT DOCUMENTS

| | | | |
|---|---|---|---|
| 996,458 | 6/1911 | Coleman | 273/58 F |
| 1,597,308 | 8/1926 | Brandt | 273/65 EC |
| 2,364,247 | 12/1944 | Shearer | 273/65 R |
| 2,524,546 | 10/1950 | Sinclaire | 273/128 R |
| 3,450,407 | 6/1969 | Russo | 273/65 EC |
| 3,700,239 | 10/1972 | Paterick et al. | 273/65 R |
| 3,884,466 | 5/1975 | MacDonald et al. | 273/65 EC |
| 3,975,016 | 8/1976 | Bodor | 273/DIG. 20 |
| 4,003,574 | 1/1977 | MacDonald et al. | 273/65 EC |
| 4,133,528 | 1/1979 | Koblick | 273/65 EF |
| 4,616,827 | 10/1986 | Bergland | 273/58 A |
| 4,776,589 | 10/1988 | Yang | 273/58 G |
| 4,925,428 | 5/1990 | Sonesson | 273/65 EC X |
| 4,930,777 | 6/1990 | Holenstein | 273/65 EC |
| 4,943,055 | 7/1990 | Corley | 273/DIG. 20 |
| 5,000,451 | 3/1991 | MacDonald et al. | 273/65 EC |
| 5,123,645 | 6/1992 | MacDonald et al. | 273/DIG. 20 |
| 5,186,458 | 2/1993 | Retonto | 273/65 EF |

FOREIGN PATENT DOCUMENTS

| | | | |
|---|---|---|---|
| 499656 | 1/1939 | United Kingdom | 273/20 |

*Primary Examiner*—George J. Marlo
*Attorney, Agent, or Firm*—Lewis Anten

[57] ABSTRACT

A training football having a weighted bar weighing at least ½ pound inside the football, located along the long axis of the football, is disclosed. In the preferred embodiment of the invention, a solid cylindrical element, in the shape of a bar, is inserted along the major axis of the training football inside a bladder. The weighted bar has convex ends that conform to the curved concave interior ends of the training football for holding the bar in place. The thickness and weight of the bar determines the weight of the training football. The bladder containing the weighted bar is inserted into the cover of the training football, so that the support ends of the bar are fitted within the ends of the cover. The bladder is inflated with air under pressure through an exterior pinch nozzle. Throwing, kicking and punting of a weighted football increases the muscles of the user that need to be strengthened in order to throw, kick or punt a conventional football. Catching the weighted football makes catching a conventional football easier.

12 Claims, 3 Drawing Sheets

TRAINING FOOTBALL

BACKGROUND

The art of throwing, kicking and punting a football requires the use of certain muscles. Strengthening these specific muscles can be achieved by conventional weight and exercise training. However, there is no certainty that the precise proper muscles used in throwing, kicking and punting a football are actually being strengthened in the desired manner.

A number of sports have used weights attached to specific pieces of sports equipment to increase the weight of the equipment in order to train the specific muscles. Base ball bats and golf clubs have had weighted rings attached to the shafts of the bats and clubs in order to increase their weight in order to strengthen the muscles used in the ordinary use of the sports equipment.

Examples of weighted football items are as follows:

The patent to Shearer (U.S. Pat. No. 2,364,247) discloses a football with a flexible rod along the longitudinal axis of the football and which has fins projecting perpendicular to the rod. The rod and fins are disclosed as being flexible so as to compress when the football is fallen on, and there is no disclosure that the insert is intended to increase the weight of the football in order to increase the strength of the muscles used in throwing or kicking the football.

The patent to Corely (U.S. Pat. No. 4,943,055) discloses a weighted warmup ball which has a metal center. The device is disclosed as being int he shape of a sphere. The patent discloses that balls and footballs have had added weights in order to strengthen the muscles used in throwing the balls. There is no disclosure that the warmup ball would be in any shape other than a sphere.

In the patent to Brandt (U.S. Pat. No. 1,597,308) a weighted football is disclosed in which the inside of the football is filled with a material to make it heavier than a conventional football.

In the patent to Russo (U.S. Pat. No. 3,450,407) an anti-fumbling football is disclosed in which a fluid is added to the interior of the football. The patent discloses that the fluid makes it more difficult to handle than a conventional football.

None of the foregoing patents disclosed a football having weighted elements oriented along the central axis of the football for adding weight to the football for strengthening the muscles used in throwing or kicking the football.

However, problems arise in merely adding weights to a non symmetrical ball, such as a football, which are not encountered in a golf club or a weighted symmetrical object, such as a baseball. The football has a oblong shape which must be thrown in a spiral to assure accuracy. The addition of weights to the football must avoid destroying the balance of the football, otherwise it can not be thrown properly. Also, the weighted training football must be caught in order to make it easier to catch a conventional football, requires that the training football be capable of being thrown in the same manner as a conventional football.

SUMMARY OF THE INVENTION

The present invention consists of a training football. The conventional football has an outer cover made of leather, or synthetics material simulating the characteristics of leather, and an inner rubber bladder that is inflated with air under pressure through an exterior pinch nozzle. The conventional football has a relatively solid oblong shape. The ends of the football are blunted. A typical football weighs between 14 and 15 ounces and has a major axis of 21¼ to 21½ inches in circumference, and a minor axis of 11 to 11¼ inches.

In the preferred embodiment of the present invention a solid, cylindrical element, in the shape of a bar, is inserted along the major axis of the training football inside the bladder. The bar has convex end portions that correspond to the concave inside ends of the football for supporting the bar in place. In an alternative embodiment of the invention, different weighted and shaped, but symmetrical, bars are fitted within the interior of the training football, to alter the weight of the training football as desired.

OBJECTS OF THE INVENTION

It is an object of the present invention to provide an improved training football that strengthens the muscles used in throwing, and kicking and punting a football;

It is another object of the present invention to provide an improved training football that simulates the characteristics of a conventional football;

It is another object of the present invention to provide improved training football that assist in the training of catching a football;

It is still another object of the present invention to provide an improved training football that is easy to manufacture; and It is yet another object of the present invention to provide an improved training football that is safer to use.

These and other objects of the present invention will be apparent from a review of the following specification and accompanying drawings.

DETAILED DESCRIPTION OF THE DRAWINGS

Figure 1:
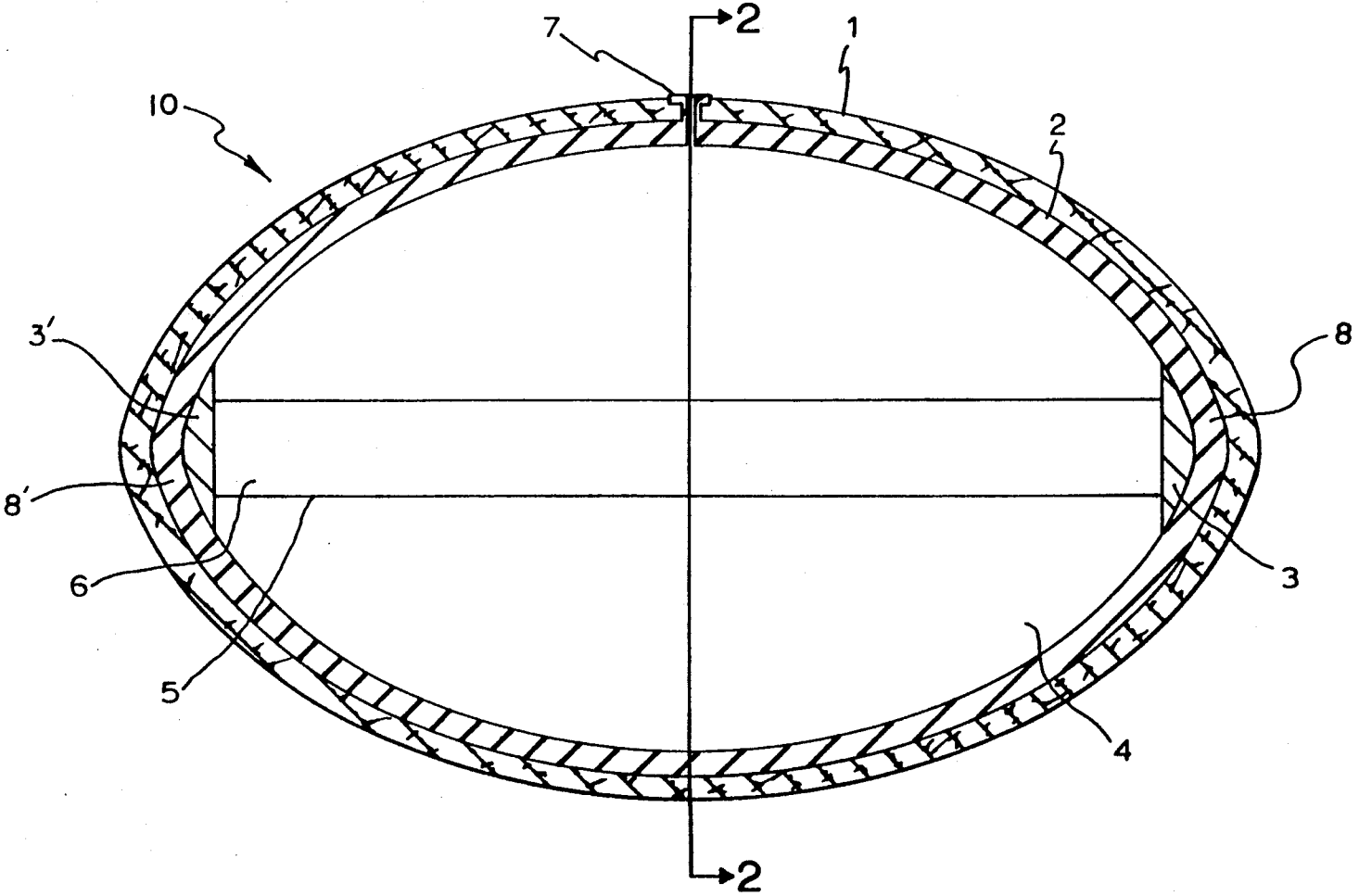
FIG. 1 is a side sectional view of the training football of the present invention.
Figure 2:
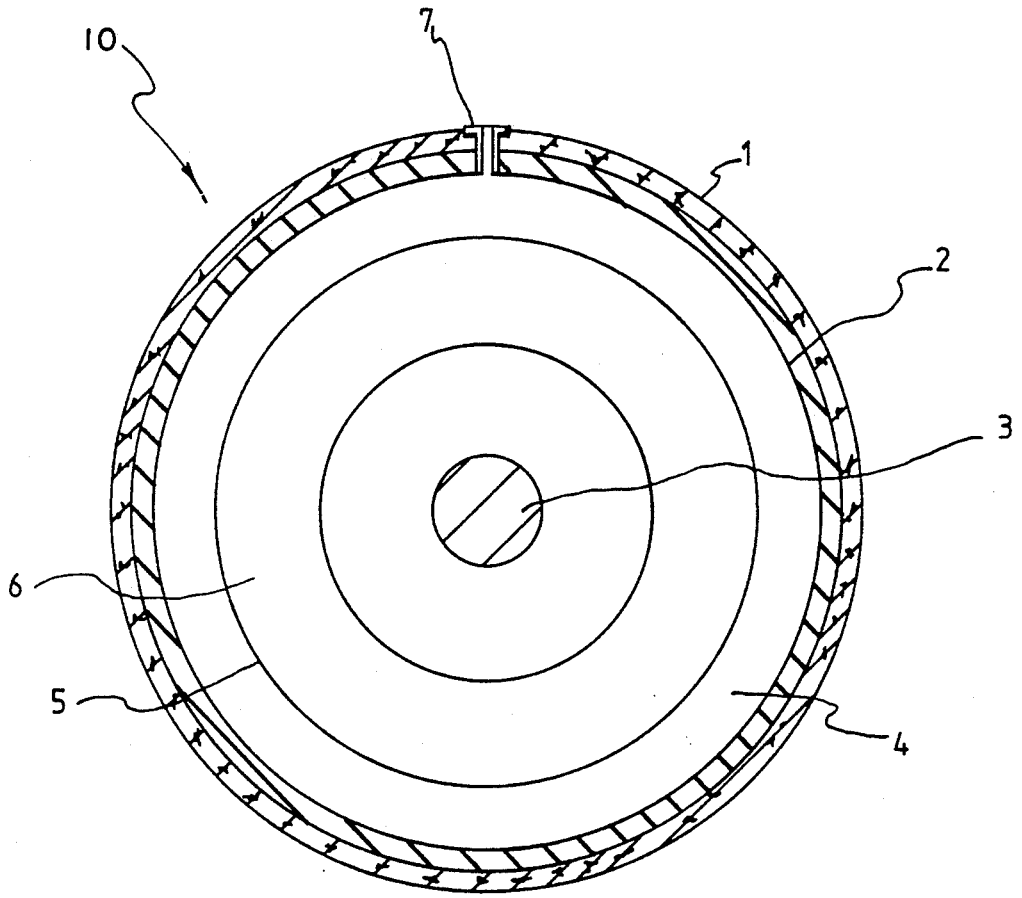
FIG. 2 is an end sectional view along lines 2—2 of FIG. 1 of the training football of the present invention.

Referring to FIGS. 1 and 2, of the drawings, sectional views of the training football 10 of the present invention is shown. The training football 10 has a major axis A and a minor axis B and is generally oblong in shape. The training football 10 has an outer cover 1, preferably leather or other synthetic material simulating the characteristics of leather. Typically the cover 1 is not entirely smooth, but is rippled, in order to assist in the grasping of the football when it is thrown or caught. Inside the cover 1 is an air tight rubber bladder 2, which is capable of being inflated, by means of a hand pump or other source of air, through a pinch nozzle 7 from the outside of the football. The bladder 2 is inflated until it fills the entire inside of the cover 1. The pinch nozzle 7 is a nozzle that is normally compressed so that air can not escape through it, but can be separated by the insertion of a hollow pin that has an attachment means for attachment to a source of air.

The rubber bladder 2 defines an empty space 4 in which is fitted a cylindrical bar 5 having end supports 3. The bar 5 is made of a heavy material, such as lead or iron, although other materials may be used as well. The end supports 3 and 3' are convex in shape and conform to the shape of the interior ends 8 and 8' of the football cover 1. The ends 3 and 3' of the bar 5 may be formed integrally with the bar 5 itself. The interior ends 8 and 8' of the training football serve to support the weighted bar 5 in place within the training football 10.

Figure 3:
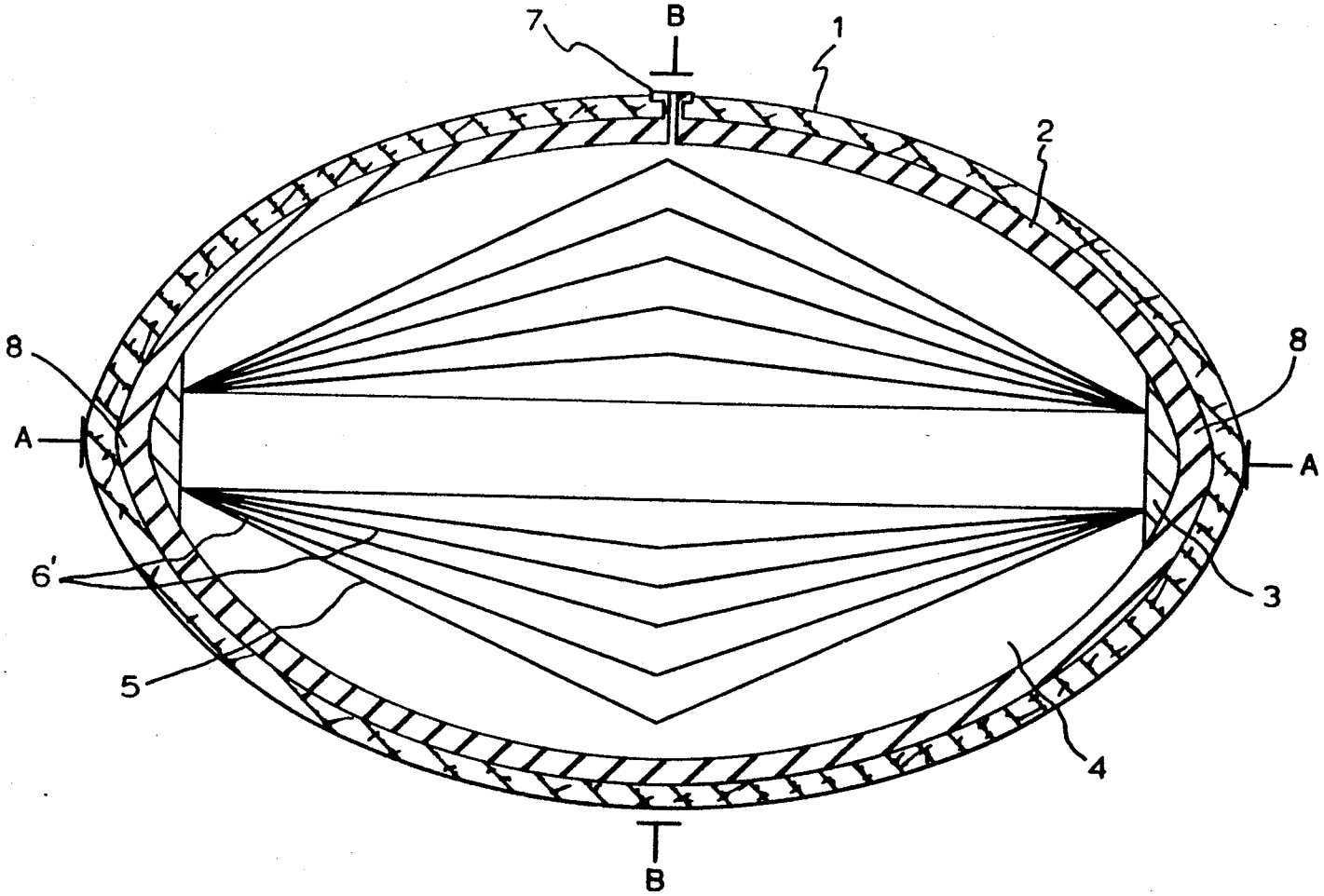
FIG. 3 is a side sectional view of the training football showing alternative shapes of symmetrical weights in the interior shown in phantom lines.

In the preferred embodiment of the present invention, the weighted bar 5 may or may not be solid. As shown in FIG. 3, weighted bars of different diameters and shapes may be used. In FIG. 3 the bars 6' shown have increased diameters at their centers and narrow uniformity approaching the ends 3 and 3'. The bar 6' forms the shape of two cones having their bases facing each other. The different sized bars 6' are selected depending on the weight to be used in the training football 10.

The training football 10 of the present invention are constructed by having the a support ends 3 and 3' attached to the bar 5. The bar 5 is then fitted through a seam (not shown) in the bladder 2. The rubber bladder is then sealed by conventional means, such as an ultra sound welding operation. The bar 5 and the rubber bladder 2 is then fitted within the training football 10 through a seam (not shown) in the cover 1, and positioned so that the support ends of the bar are fitted within the ends of the cover 1. The seam in the cover 1 is then closed and air is inserted into the rubber bladder 2 through the air inlet 7 from a suitable source of air.

The weighted bar 5 is symmetrically oriented along the major axis A of the training football 10 so that it does not change the characteristics of the training football 10 when thrown. Preferably the weight is distributed as close to the major axis A as possible to avoid excessive turning or tumbling of the training football 10 in the event that the training football 10 is not properly thrown. In the preferred embodiment of the present invention the weighted bar 5 weighs ½ lb., and is increased in units of ½ lbs. until a desired weight is reached.

It is contemplated that the persons using the training football 10 will initially select the lightest of the training footballs 10 and then after they are able to throw the training football 10 comfortably, they would gradually use training footballs 10 that are increasingly heavy. The same pattern of using increasingly heavier training footballs 10 for catching would also be used.

While the present invention has been described with regards to the preferred embodiments, it must be recognized thet it is possible to make other variations of the present invention without departing from the scope of the present invention.

What is claimed is:

1. A training football comprising a resilient outer cover having a major axis and a minor axis, said training football having a rigid weighted element weighing at least ½ pound in the interior of the football along the major axis of the football to significantly increase the weight of said football, said weighted element having a first pair of ends along said major axis, said weighted element being supported at said first pair of ends along said major axis by the interior surface of said outer cover of the training football.

2. The training football of claim 1 in which said weighted element is in the shape of a bar.

3. The training football of claim 1 in which said first pair of ends of said weighted element are convex and conform to a concave area defined by the interior of said outer cover converging toward said major axis to form a second pair of ends of the training football.

4. The training football of claim 1 including an interior, air tight bladder capable of being filled with air under pressure, and said weighted element being fitted within said bladder.

5. The training football of claim 1 in which the weight of said weighted element is symmetrically oriented along the major axis of said training football.

6. The training football of claim 5 in which said weighted element is a cylindrical member.

7. The training football of claim 5 in which said weighted element is in the shape of two cones having their bases facing each other and said first pair of ends of said weighted element being convex to conform to the interior surface of said outer cover at said second pair of ends of the football.

8. The training football as recited in claim 1 in which said outer cover is made of leather.

9. The training football as recited in claim 8 further including an interior air tight bladder capable of being filled with air under pressure, and said weighted element being fitted within said bladder.

10. The training football as recited in claim 1 in which said outer cover is made of rubber.

11. The training football of claim 1 in which said weighted element is solid.

12. The training football of claim 1 in which said weighted element is made of metal.

* * * * *